US007278385B2

(12) United States Patent
Knecht et al.

(10) Patent No.: US 7,278,385 B2
(45) Date of Patent: Oct. 9, 2007

(54) CAMSHAFT ADJUSTER WITH A LOCKING POSITION THAT, WITH REGARD TO DESIGN, IS FREELY SELECTABLE

(75) Inventors: Andreas Knecht, Kusterdingen (DE); Gordon Neudoerfer, Ulm/Maehringen (DE); Ralf Naumann, Unterensingen (DE)

(73) Assignee: Hydraulik-Ring GmbH, Marktheidenfeld (DE)

( * ) Notice: Subject to any disclaimer, the term of this patent is extended or adjusted under 35 U.S.C. 154(b) by 0 days.

(21) Appl. No.: 11/369,519

(22) Filed: Mar. 6, 2006

(65) Prior Publication Data

US 2006/0144357 A1 Jul. 6, 2006

Related U.S. Application Data

(63) Continuation of application No. PCT/EP2004/053531, filed on Dec. 16, 2004.

(30) Foreign Application Priority Data

Mar. 11, 2004 (DE) ..... 10 2004 012 460

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18, 90.27, 90.31; 464/1, 464/2, 160

See application file for complete search history.

(56) References Cited

U.S. PATENT DOCUMENTS

| | | | |
|---|---|---|---|
| 5,832,887 | A | 11/1998 | Adachi et al. |
| 5,937,808 | A | 8/1999 | Kako et al. |
| 6,155,219 | A | 12/2000 | Fukuhara et al. |
| 6,192,844 | B1 | 2/2001 | Scheidt et al. |
| 6,263,843 | B1 | 7/2001 | Todo et al. |
| 6,374,786 | B1 | 4/2002 | Ogawa |
| 6,374,788 | B1 | 4/2002 | Fukuhara et al. |
| 6,378,477 | B1 | 4/2002 | Fukuhara et al. |
| 6,460,496 | B2 | 10/2002 | Fukuhara et al. |
| 6,704,642 | B2 | 3/2004 | Moriya et al. |
| 6,758,178 | B2 | 7/2004 | Takahashi et al. |
| 6,779,499 | B2 | 8/2004 | Takenaka et al. |
| 2001/0017114 | A1 | 8/2001 | Mikame |
| 2003/0066501 | A1 | 4/2003 | Park |

FOREIGN PATENT DOCUMENTS

| | | |
|---|---|---|
| DE | 198 19 360 | 6/1999 |
| DE | 198 56 318 | 6/2000 |
| DE | 102 22 680 | 5/2003 |
| DE | 102 53 883 | 5/2004 |
| EP | 1 087 107 | 3/2001 |
| EP | 1 128 027 | 8/2001 |
| WO | 97/31179 | 8/1997 |

OTHER PUBLICATIONS

*Patent Abstracts of Japan*, Publication No. 11173119, "Method and Device For Controlling Valve Timing for Internal Combustion Engine", Jun. 29, 1999.

*Primary Examiner*—Ching Chang
(74) *Attorney, Agent, or Firm*—Lipsitz & McAllister, LLC

(57) ABSTRACT

Camshaft adjusters are provided for changing the position of a camshaft of an internal combustion engine. One such camshaft adjuster has a locking position that, with regard to design, is freely selectable.

25 Claims, 8 Drawing Sheets

Section A-A

Section B-B

Section C-C

Section D-D

CAMSHAFT ADJUSTER WITH A LOCKING POSITION THAT, WITH REGARD TO DESIGN, IS FREELY SELECTABLE

This application is a continuation of International Application No. PCT/EP2004/053531 filed on Dec. 16, 2004, which application claims priority of German Patent Application No. 10 2004 012 460.4 filed on Mar. 11, 2004.

BACKGROUND OF THE INVENTION

The invention relates to an adjustment device for camshafts which are used in internal combustion engines, such as for example of motor vehicles, according to the preamble of claim 1.

The object of camshaft adjusters is to alter the position of a camshaft of an internal combustion engine. The opening and closing time or the extent of opening of a gas exchange valve of the internal combustion engine are affected thereby. Camshaft adjusters are available in many embodiments. Camshaft adjusters are therefore known which displace a hydraulic piston in the axial direction. Camshaft adjusters with helical gear teeth are also known. A further type of camshaft adjuster functions in the manner of a hydraulic oscillating motor which is equipped with at least one stator and with at least one rotor. The stator forms the fixed reference position which, however, as a whole may be in rotation. The rotor alters its position relative to the fixed reference position of the stator. A camshaft to be adjusted is attached directly or indirectly to the rotor. If the rotor alters its position relative to the stator, the position of the cams on the camshaft is also altered.

Many of the known camshaft adjusters are operated with oil. A particular hydraulic oil or even standard engine oil of the internal combustion engine may be used therefor. During particular operating conditions of the internal combustion engine, such as for example idle running, starting up or switching off the engine, it can occur that the camshaft finds its way into a disadvantageous position or location. Moreover, the system made up of the internal combustion engine and camshaft adjuster is designed for normal operating conditions. This means that at lower temperatures, in particular winter temperatures, the viscosity of the oil used, for example engine oil or hydraulic oil, is too low.

All these situations may cause less efficient starting behaviour of the internal combustion engine. By incorrect opening of the gas exchange valve, the performance of the internal combustion engine may be unnecessarily reduced, the internal combustion engine may generate an undesirably high amount of noise and the exhaust gas value may not correspond to the necessary legal requirements.

Experts in the field have known about these and other problems for years. In order to counteract the problems, numerous camshaft adjusters have been developed which have a locking mechanism. It has been proposed in GB 2 319 071 A to use a spring biased pin which can be hydraulically adjusted such that the rotor remains in the so-called retarded position relative to the stator.

In a system according to EP 1 143 113 A2, a complete hydraulic system is proposed which with a plurality of pistons may lock the rotor relative to the stator.

DE 198 56 318 A1 proposes to provide an air bleed tube which at the time of unlocking the rotor is substantially unpressurized.

DE 198 60 418 A1 also uses a spring which cooperates with a locking element. An angle-limiting groove is provided in a side wall. The angle-limiting groove has groove ends which are constructed as angle-limiting stops. A stop bolt may adjust the impeller relative to the drive wheel within the pivoting angle formed by the angle-limiting groove.

The US 2001017114 A1 discloses in its drawings a rotor with a locking pin arrangement having two springs. One spring biases a stopper block. One spring biases a push spring.

The U.S. Pat. No. 6,374,786 B1 discloses a biased spring. In its corresponding EP-application EP 1 087 107 A1, two embodiments are shown. One embodiment shown in FIG. 7 illustrates a lock spring.

The three published patent applications DE 101 33 444 A1, DE 101 33 445 A1 and DE 101 62 553 A1 appear to disclose thematically the same valve control device. Two camshaft adjusters which comprise a spring are operated. According to the characteristic curves represented, there is a locked region and a released region. Depending on the oil pressure the locking pin is switched to and fro with a hysteresis between the locked region and the released region. In spite of the hysteresis region, the system might be denoted as a static exchange system between the locked region and the released region.

In the two published patent applications DE 196 06 724 A1 and DE 102 13 831 A1 variable valve timing devices are disclosed which are equipped with two engagement elements. DE 196 06 724 A1 shows a camshaft adjuster which displaces the adjusting piston in the axial direction. The adjusting piston operates with a helical gear tooth portion. DE 102 13 831 A1 proposes to use a delay angle restricting pin and a lock pin. When an engine stalls, the rotor is generally designed to move to, and stop at, the most delayed angle position to make it difficult to start the engine again. By means of the delay angle restricting pin, this may only occur in a specific context. In particular by means of the hydraulic circuit diagrams, it is clear that this system has to be equipped with a plurality of chambers, so that it may function. Every hydraulic engineer understandably attempts to reduce the number of chambers as far as possible. A design engineer, in turn, wishes to keep the number of components and the redesigned spaces as small as possible.

A very well developed system has been proposed in DE 102 53 883 A1. The camshaft adjuster has been provided with a locking mechanism. The locking mechanism may intervene in particular operating conditions. The invention is thus based, amongst others, on the fact that the adjustment speed is delayed over the period. In other words, it may also be said that the adjustment speed is slightly reduced in the region of the locking mechanism. In this connection, a fixed mechanical stopping point is used. The invention may be used with such adjusters which are denoted as low speed adjusters.

Further adjusters are known from U.S. Pat. No. 6,155,219 and DE 102 13 825 A1 which exhibit a spring-biased locking pin and a spring. The spring is respectively positioned vertically to the shaft to be adjusted. The spring acts on a bushing or a lug and/or hook groove. According to U.S. Pat. No. 6,155,219, the spring ensures the rotor is held in an advanced or retarded position, before the first ignition. In DE 102 13 825 A1 by means of the connection of the spring, the coiled portion is designed to be prevented from becoming inclined.

SUMMARY OF THE INVENTION

It is therefore the object of the present invention to alter such a highly integrated system, as that of DE 102 53 883, to such an extent that the locking position of the camshaft between the advanced and retarded positions may be also variably adjusted, a regularly repeatable locking position being able to be optionally provided each time the engine is switched off. It is intended for it to be possible to move through substantially the entire adjusting range without retardation points.

This object is achieved with the generic camshaft adjuster according to the invention with the features of claim 1 and the features of claim 10. Advantageous embodiments can be found in the dependent claims.

The camshaft adjuster according to the invention which may be used with internal combustion engines, has at least two chambers which are adjustable in their volume and which are configured in counter rotation. If the volume of the one chamber is enlarged, the volume of the corresponding second chamber automatically and correspondingly reduces and vice versa. The camshaft adjuster has a stator and a rotor. The stator and rotor may be moved relative to one another. A receiver is provided in the rotor for a camshaft. By means of oil pressure which may be fed into the chambers, the position of the rotor may be altered relative to the stator. The camshaft adjuster thereby adjusts the camshaft. Thus via a relative rotation the camshaft adjuster adjusts the angle of the camshaft relative to a crankshaft of the internal combustion engine. Depending on an influencing variable the camshaft adjuster follows one of at least two characteristic curves provided. When the camshaft adjuster follows the one characteristic curve, it is therefore not possible for it to follow simultaneously the other characteristic curve. Thus it follows the characteristic curves alternately. The precise position of the relative rotation is varied by the oil pressure which as a rule is in a range below 1 bar. The choice of which characteristic curve is to be followed, determines the influencing variable. If the conditions of the influencing variable are exceeded, for which the camshaft adjuster is designed by its mechanical elements, the locking mechanism engages the locking position which, with regard to design, is freely selectable.

The camshaft adjuster is equipped with a mechanical stop. The stop forms a stop position. The stop may be displaced as soon as a specific biasing force is exceeded. Below the biasing force, the stop is fixedly anchored. In this case, the stop is not displaceable but fixed.

The camshaft adjuster is equipped with different stops. In the prior art it is known that a camshaft adjuster may adopt a minimum and a maximum position. This is the advanced position and the retarded position. The positions are determined by mechanically fixed stops. A displaceable position exists therebetween. The displaceable position which is determined by a stop, may adopt a fixed, locked position.

Torques are introduced into the camshaft adjuster. The introduction of torques is carried out by the camshaft or by altering the oil pressure in the chambers. Frequently, the torque introduction is carried out twice. To this end, a counter torque is created. The counter torque is mechanically implemented in an advantageous embodiment.

It is particularly advantageous, if at least one of the two characteristic curves is implemented in the camshaft adjuster by simple mechanical means. Preferably the at least two of the characteristic curves present may also be implemented by a combination of mechanical components or elements.

The stator and the rotor together form a hydraulic oscillating motor. The stator is equipped with webs. The webs define the angular range which the rotor may cover. Frequently, oscillating motors are designed such that they may cover between 0° and 30°. Preferably an oscillating motor is designed for a maximum angular range which may be for example 22°. A receiver is provided for a camshaft which may be rotationally twisted. Frequently, the receiver is positioned about the center point, or the central axis of the camshaft adjuster. The rotor twists in a rotational manner relative to the stator. It drives the camshaft with its rotary motion.

As already indicated, the selected influencing variable may be an engine oil pressure or an oil pressure of the internal combustion engine, a temperature of the internal combustion engine or the speed of the internal combustion engine, which in turn influence the oil pressure.

Advantageously, the internal combustion engine may also be designed such that it follows a combination of different parameters. Different characteristic curves are alternated between, on the basis of the influencing variable. These characteristic curves may be a continuous operation characteristic curve, a starting characteristic curve, a switch-off characteristic curve or an idling characteristic curve. It is also conceivable that the starting characteristic curve and the idling characteristic curve are identical.

By using, for example, springs for the mechanical implementation of the characteristic curve, the dependence between the angle of rotation to the crankshaft and the oil pressure may be illustrated at least partially approximately linearly. It is generally known to the person skilled in the art that a spring is not linear at all forces. The spring is therefore selected such that it is approximately linear at the relevant starting point or locking point.

Moreover, it is also possible that the two implemented characteristic curves continuously partially overlap, the second characteristic curve having at least one discontinuous point, a discontinuous jump, due to a locking pin or a locking mechanism. Thus the characteristic curve is divided into two regions, into a region independent of the oil pressure and into a region dependent on an influencing variable such as the oil pressure. In the non-dependent region the characteristic curve has no gradient.

It has proved to be particularly suitable that a spiral spring is introduced in the camshaft adjuster. A locking pin is equipped with a further spring. Two springs work against the oil pressure within the camshaft adjuster. The one spring is a spiral spring and the other spring is a cylindrical helical compression spring.

The rotor and the stator together form an oscillating motor. In this connection the stator has webs which face from the edge of the stator to the center of the oscillating motor. The stator could be compared in the widest sense to a spoked wheel. The rotor is surrounded by the stator. It is located toward the center of the stator. The webs of the stator face in the direction of the center, but even in the center do not come together. The rotor and stator together form hydraulic chambers which may be altered in their size and volume by the twisting of the rotor. During operation, the hydraulic chambers are filled with a hydraulic medium, such as for example a hydraulic oil or an engine oil. The hydraulic medium is pressurized. The position of the rotor is altered according to the pressure ratio in the respective chambers. The rotor has blades. On its own, therefore, a rotor has the appearance of a star. As the hydraulic medium exerts different pressure on the sides of the blades of the rotor, the blade moves in one or the other direction. Moreover, the camshaft adjuster is equipped with a spring. Furthermore, the camshaft adjuster has a locking device. The locking device may in a simple case consist of a simple locking pin. Numerous locking devices are however known from the prior art which comprise a pin, a spring and a hydraulic cylinder. The aforementioned spring differs from the spring of the locking pin. The spring of the first type is supported on the stator due to a mechanically rigid connection with the stator. Alternatively, it may also be a press fit. All conceivable different variants, where a spring has a counter bearing, are referred to as fixed anchoring at one point of the stator. A torque of the rotor is produced due to the pressure of the hydraulic medium. The spring forms a corresponding counter torque. Thus there are defined counter torques over the entire angle of rotation of the rotor. Depending on the design of the spring, a linear relationship to the angle of rotation may be associated with the counter torque.

Moreover, there is a driving element between the stator and rotor. The driving element may be configured in the form of a driving disc. If the driving disc is viewed from the installation direction, the driving disc has the form of a closed ring. At a few points on the driving disc said driving disc has projections. They are denoted as teeth. The teeth are located respectively on the inner and/or outer edge of the ring-like driving disc. The teeth are designed either to engage in the rotor or in the stator. So that the teeth engage with the stator or the rotor, they are oriented with the rotor on the inner face, or for the stator oriented toward the outer face of the ring. The rotor and the stator provide larger recesses in the engagement region. The teeth and recesses may be located on different planes, extending parallel to one another, in the camshaft adjuster. They have the appearance of two overlapping rings, offset to one another. By means of the recesses, the rotor or the stator provides a free-running region. As the rotor and stator together have a substantially round design, the free-running region may be denoted as the notch in the driving disc. The form of driving disc together with the spring which is supported on one point of the stator, form the path of one or both characteristic curves. By means of a clever design of the driving disc or the spring coil the path of the counter torque is affected and determined. It then has the form as has been represented in the characteristic curve.

A horizontally constructed spiral spring is particularly advantageously used for the fixedly anchored spring. The spiral spring with its spring steel encircles the common center or central axis of the oscillating motor. It is located parallel to the rotor. By means of this type of spring which is of small width, distortion, imbalance or stiffness are avoided.

In the variants which are more expensive according to the number of components, the locking pin in the form of a locking device is provided with a spring, so that the locking pin is biased. The locking pin may be arranged in a blade. It is also conceivable that the locking pin is located in a web of the stator. When the pressure of the hydraulic medium falls below a minimum pressure in the region of the locking pin, the locking pin moves into a position in which the rotor is anchored with the stator. It is advantageous if the anchoring has very little play. The rotor then exhibits in the locked position substantially no more movement than the stator. In this case the rotor and stator run synchronously. Below the minimum pressure of the hydraulic medium, the pressure ratios in the oscillating motor do not have to be taken into account. The rotor therefore has, irrespective of the pressure, the same rotational movement as the stator. For this a specific valve which does not form a unit with the camshaft adjuster, but is only hydraulically connected thereto, is provided for the locking device. The hydraulic valve is controlled according to a parameter, such as for example the pressure ratios in the oscillating motor or the speed or the temperature. Thus the additional valve determines the locking point. A relationship exists between the locking force and the spring adapted thereto, which biases the locking pin.

The camshaft adjuster is equipped with a cover. The cover is fastened to the stator via countersunk fixings, in particular countersunk screws. The opposing side of the camshaft adjuster is covered by a chain wheel. The chain wheel is located perpendicular or at right angles to the central axis of the camshaft adjuster. Thus the chain wheel and the cover form the two outer limits of the camshaft adjuster.

The spring, which determines the counter torque is attached to the driving element at its other end, the end which is not connected to the stator, in an alternative embodiment the spring is located under the cover of the stator. The other end of the spring opens out in a collar. The collar has an aperture. The sides of the collar encircle the rotor seating.

BRIEF DESCRIPTION OF THE DRAWINGS

The advantages of the invention may be understood more clearly by reference being made to the corresponding Figures, in which:

Figure 1:
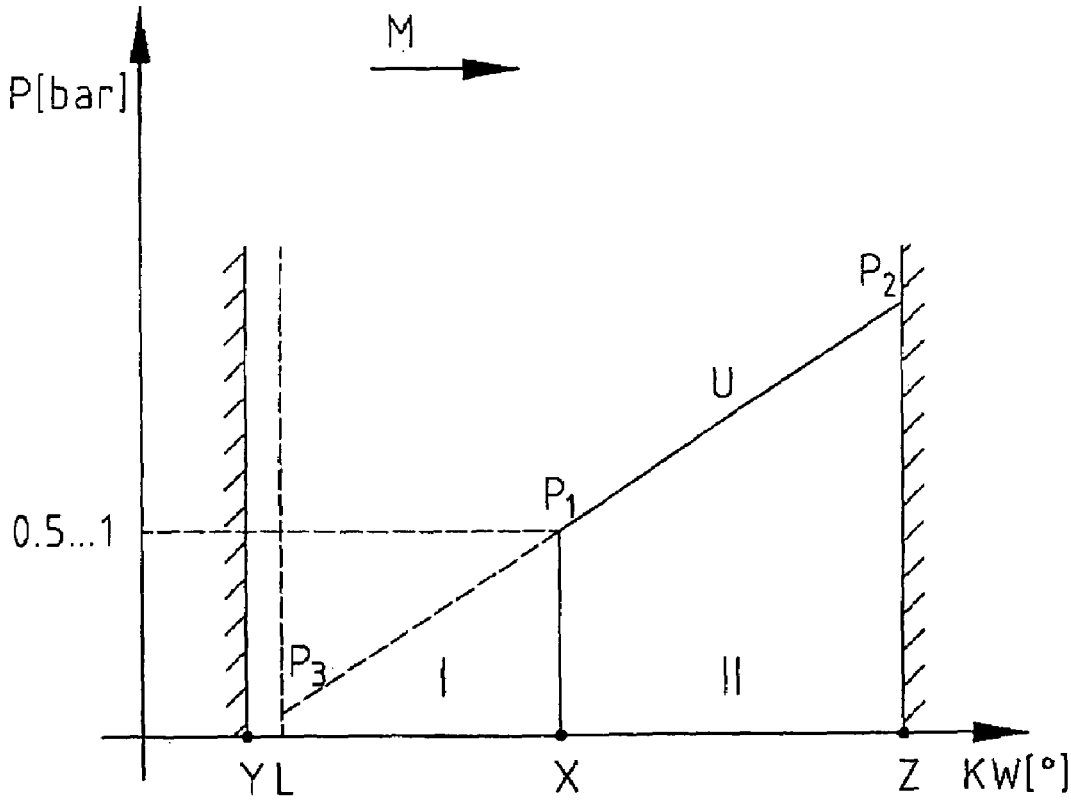
Figure 2:
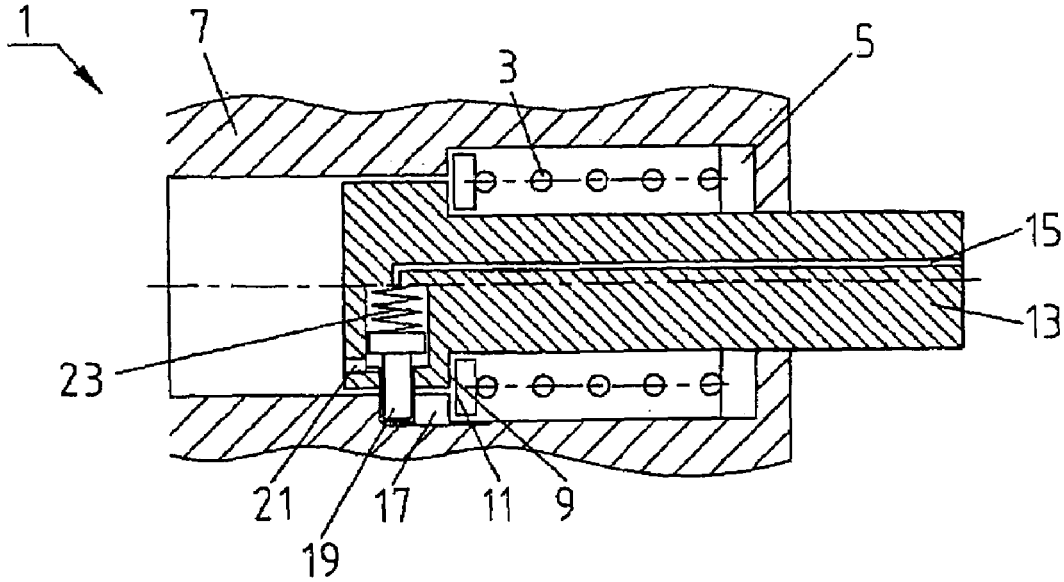
Figure 3:
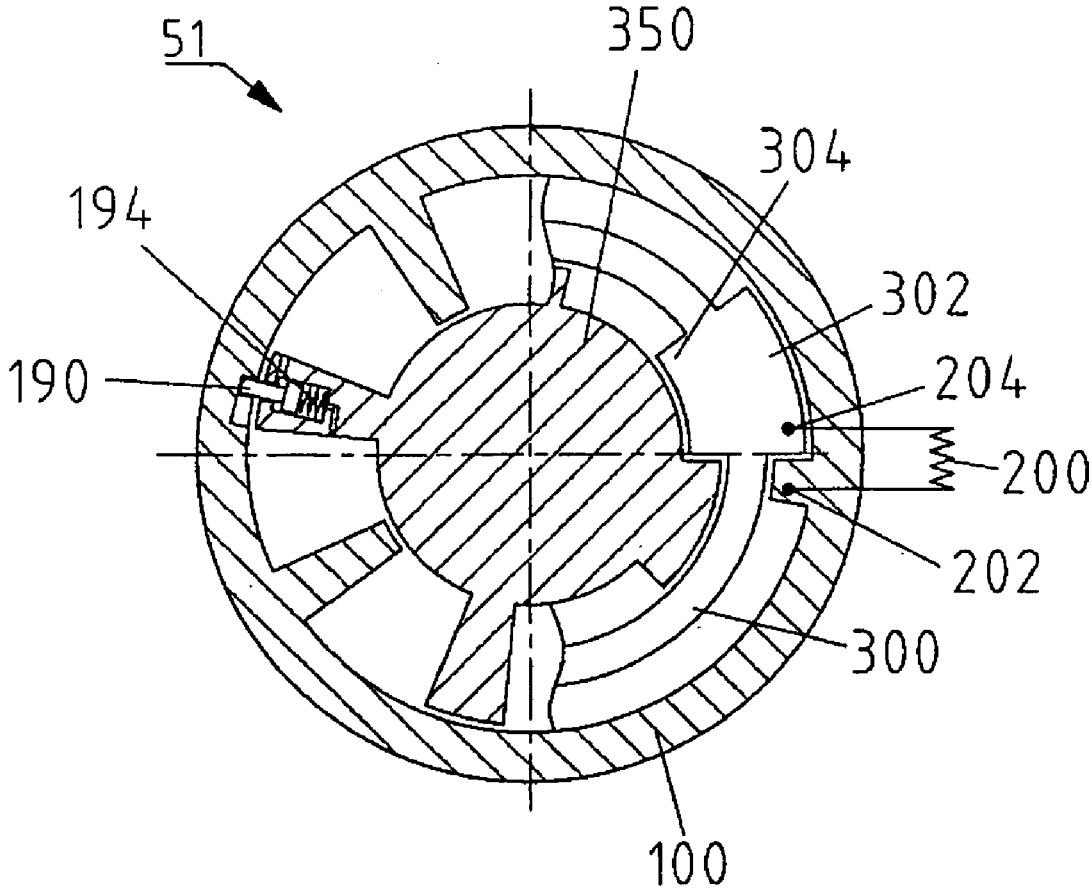
Figure 4:
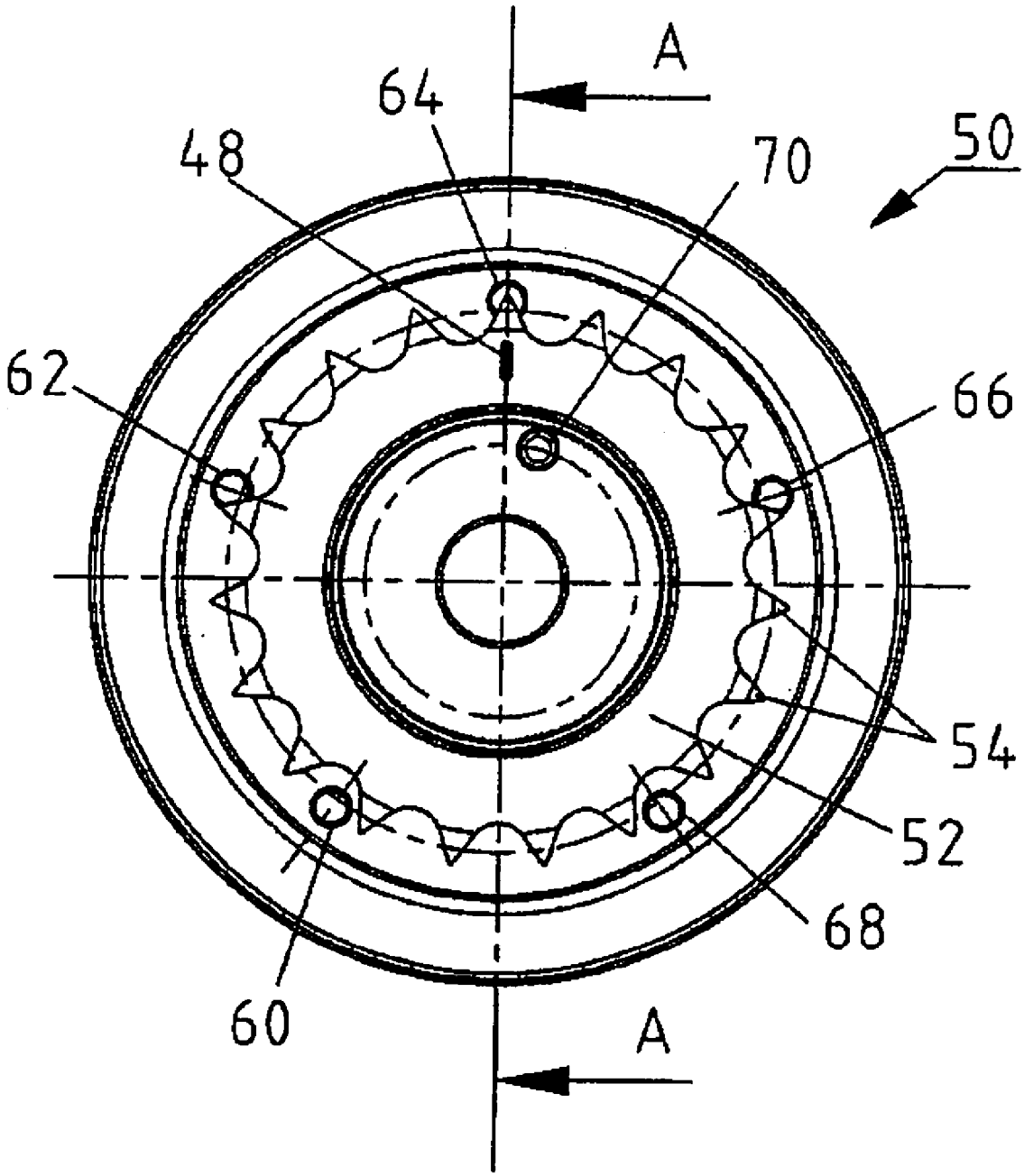
Figure 5:
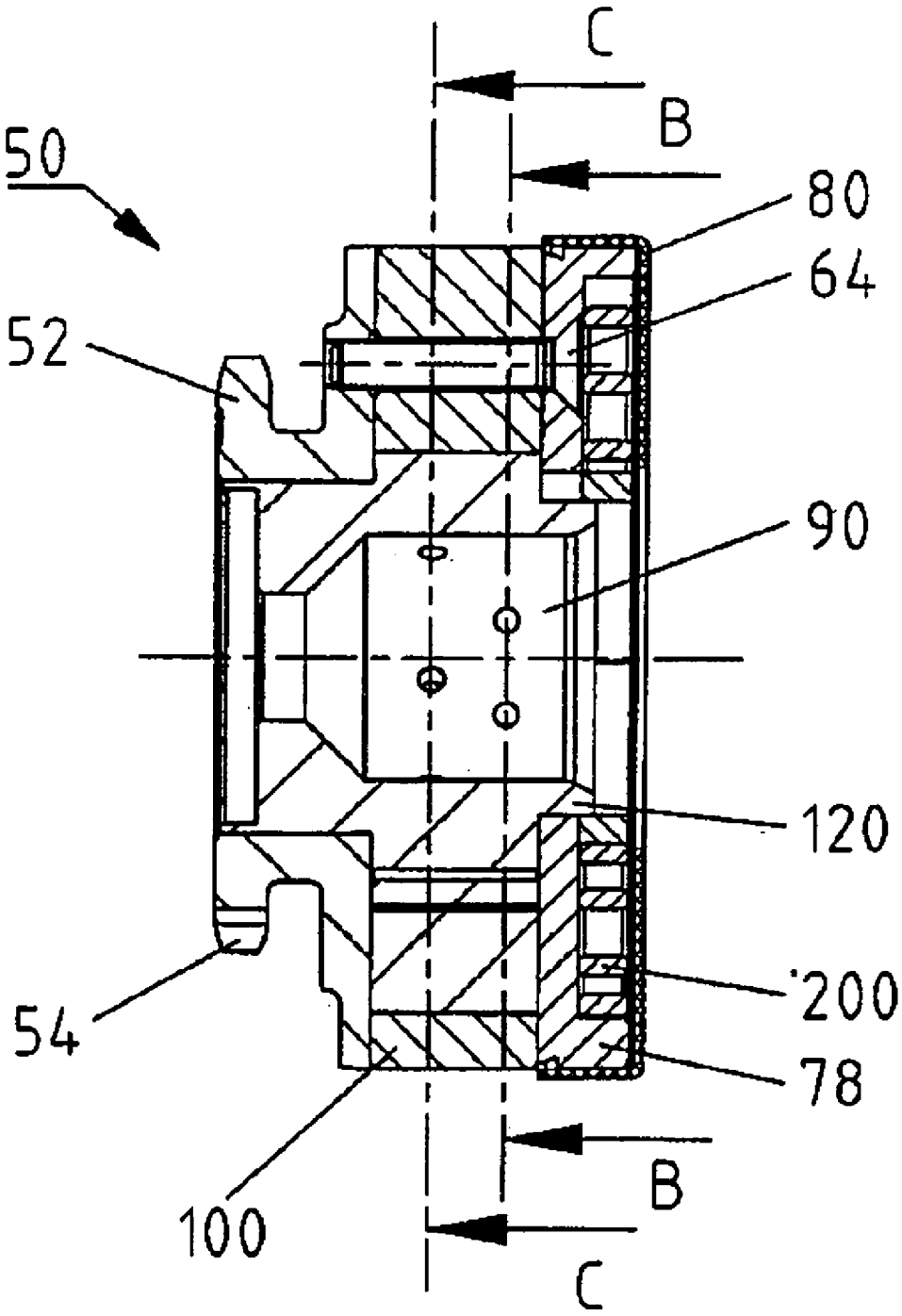
Figure 6:
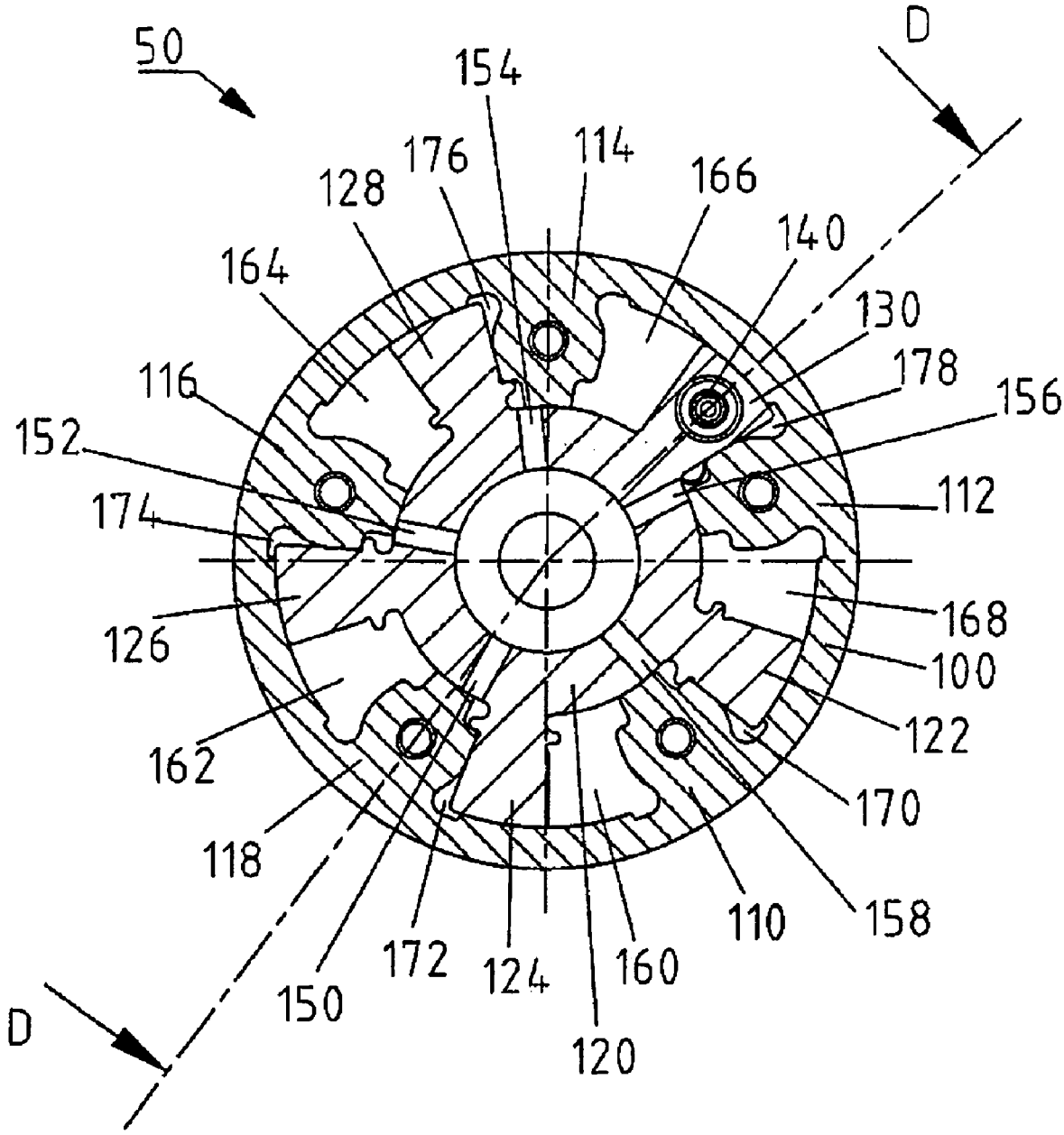
Figure 7:
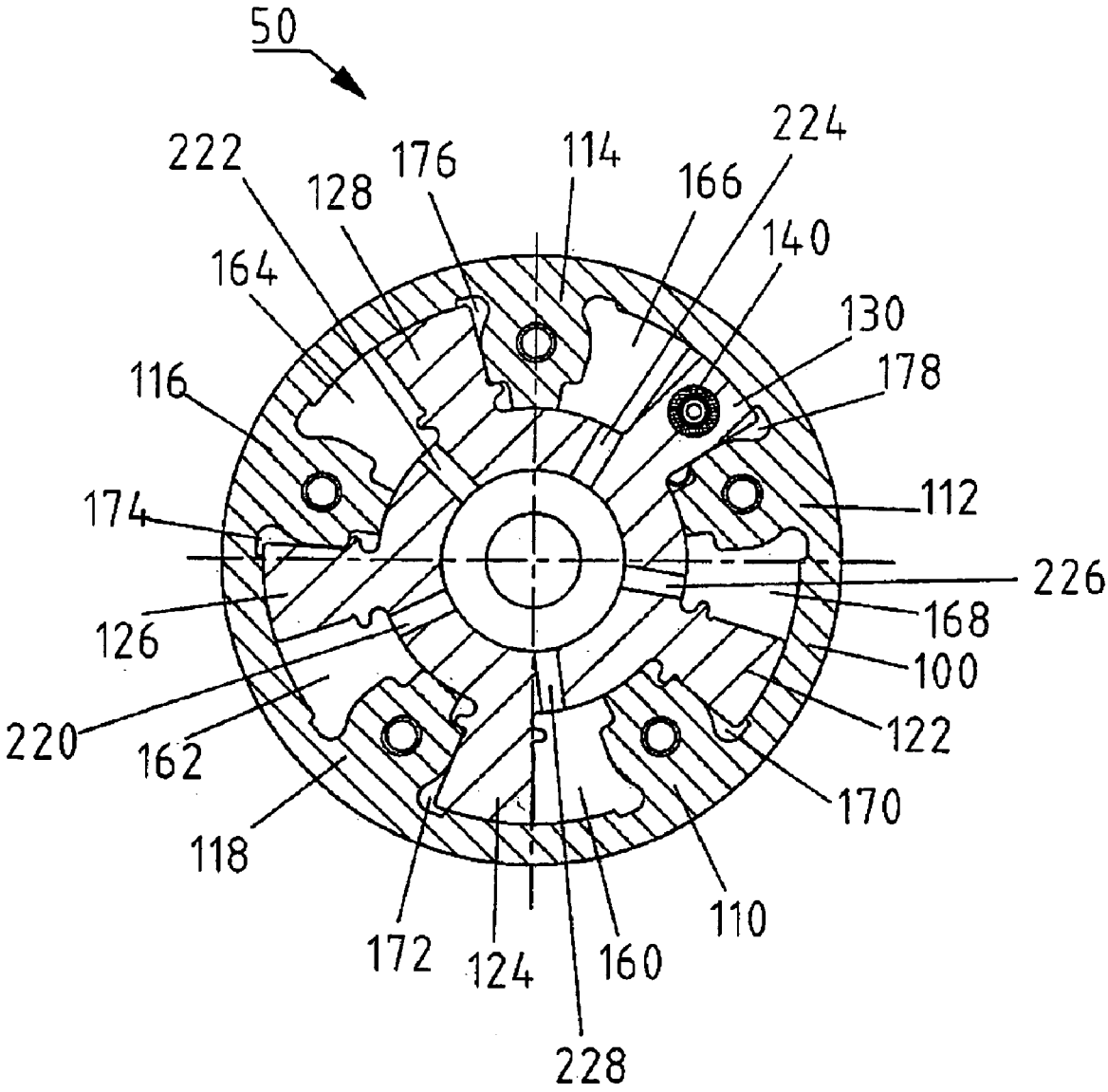
Figure 8:
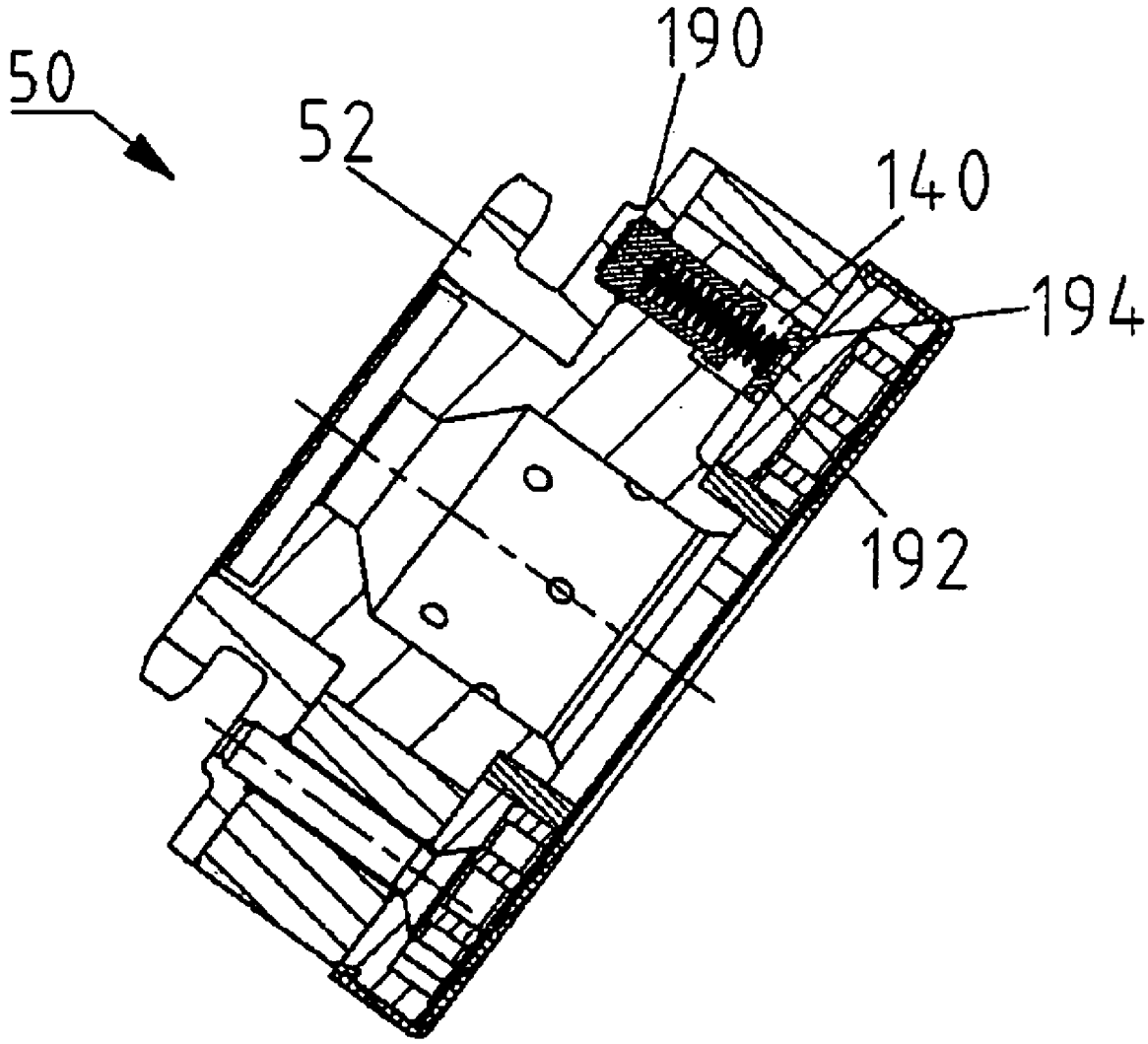
Figure 9:
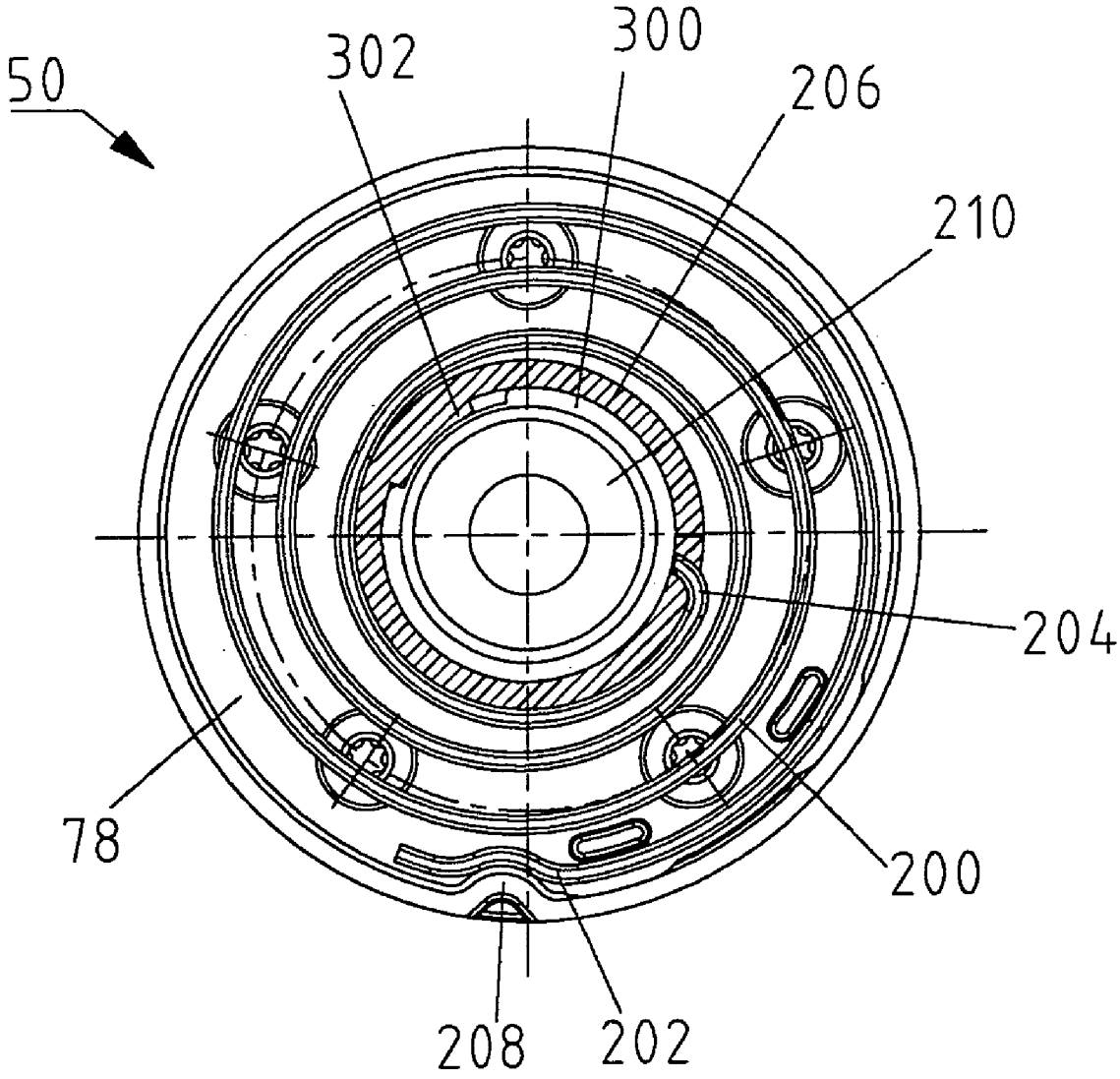

| | |
|---|---|
| FIG. 1 | is the torque characteristic curve of the camshaft adjuster depending on the angle of rotation of the crankshaft of the internal combustion engine relative to the pressure, |
| FIG. 2 | is the hydraulic principle of the invention in linearized form, |
| FIG. 3 | is a schematic embodiment with the driving element which moreover is very similar to the camshaft adjuster according to FIGS. 4-9, |
| FIG. 4 | is a view of an embodiment of a camshaft adjuster according to the invention, |
| FIG. 5 | is the camshaft adjuster along section A-A of FIG. 4, |
| FIG. 6 | is the view along section B-B of the camshaft adjuster according to FIG. 4, |
| FIG. 7 | is the camshaft adjuster according to FIG. 4 along the section C-C, |
| FIG. 8 | is the camshaft adjuster of FIG. 4 along the section D-D, |
| FIG. 9 | is the camshaft adjuster of FIG. 4 along the other side but without the cover. |

DESCRIPTION OF PREFERRED EMBODIMENTS

FIG. 1 shows a torque characteristic curve of a camshaft adjuster according to the invention. The adjustment of the camshaft relative to the crankshaft is illustrated on the abscissa. The abscissa shows at least three points. The characteristic curve ranges between the advanced position Y and the retarded position Z. In addition a selected idling position L and a starting position X are indicated. The pressure of the hydraulic medium P is provided in bar on the ordinate. Alternatively, the initial pressure of the oil supply of the system may be also plotted here. Thus the characteristic curve creates a relationship between the angular adjustment of the crankshaft, a torque of the camshaft and a pressure. With increasing torque a counter torque is formed. The gradient of the characteristic curve U is determined by the return spring 200 of FIG. 3 or FIG. 9. The return spring does not act in the one region I, the free-running rotor region. In the second region II the return spring 200 acts in the form of the gradient U. The location of the starting position X is set by the locking device. It can be set at any point between the advanced position Y and the retarded position Z by means of the optimal choice of the return spring and locking device. It is solely determined by the requirements of the internal combustion engine. The associated pressure at the starting position X is denoted as P1. It generally lies in a pressure range between 0.5 and 1 bar. Alternatively, however, it may lie below and above said range. The point which is associated with the retarded position is represented as P2 in the characteristic curve of FIG. 1. The pressure which would have to be present at the idling position L, is denoted by P3. At the starting position, in the locked state, the characteristic curve has a discontinuity point. Only by altering the pressure can the counter torque act. Due to the discontinuity point, two torque characteristic curves can be referred to. A first characteristic curve is present in which the spring torque is not effective. A second torque is present when the discontinuity is omitted. The characteristic curve is shown dependent on the pressure as said pressure may be easily measured and have an effect as a reference value. There is a clear relationship between the pressure and the torque. As the torque is directly proportional to the pressures of the hydraulic medium, in practice the pressure is measured to express the torque according to the following formula:

$$\vec{P} = \frac{\vec{F}}{A} = \frac{\vec{F}}{l * r} \Leftrightarrow \vec{F} = \vec{P} * (l * r)$$

$$M_{blade} = \vec{F}.\vec{r} = (l * r)\vec{P} * r$$

$$= l \int Prdr$$

$$M_{rotor} = n * M_{blade} = nl \int_{-\frac{b}{2}}^{\frac{b}{2}} Prdr$$

where:

| | |
|---|---|
| l | blade width |
| P | the pressure of the hydraulic medium |
| dr | the differential blade length |
| r | control variable - blade length |
| n | number of blades |
| $M_{blade}$ | blade torque |
| $M_{rotor}$ | rotor torque |
| b | offset blade length |

The characteristic curve represents the standard terminology in general use with the Applicant and their numerous clients in the automotive field. A variant which is also common, is the representation of the difference angle between the crankshaft and camshaft. A further variant is the relative relationship solely with the crankshaft. Where the locking pin is aligned, the rotor follows the stator in the one direction of rotation, whilst in the other direction of rotation free-running is possible. It is only necessary for the spring to be impinged upon when the stop position is reached.

If the characteristic curve is transferred to a linear hydraulic piston design, a similar view as in FIG. 2 is obtained. The linearized hydraulic cylinder 1 has a housing 7. It is equipped with a coil spring 3 which is supported relative to the bearing 5. The piston area 9 and the stop 11 act in opposing directions, the stop surface of the stop 11 having to counteract the spring 3 bias. The piston 13 with the piston area 9 is equipped with an equalization or bleed line 15. The piston 13 is equipped with a locking mechanism which is equipped with a locking pin 19 and a biased spring 23 for the locking pin 19. The spring 23 biases the locking pin 19 against the housing 7 under a pressure of the hydraulic medium. In the locking state shown in FIG. 2, the locking pin 19 prevents the free-running of the piston 13, when the locking pin strikes against the housing wall within the projection 17 or the free-running region 17. Under pressure, that is when the hydraulic medium is pressurized, the hydraulic medium presses the locking pin 19 via the control line 21 against the biasing spring 23 and thus lifts the locking pin out of its engagement. The piston may then run freely from a first stop as far as a second stop. The free-running region 17 is defined by a guide face which lies in a different plane from the cutting plane represented in the schematically shown FIG. 2.

In FIG. 3 a schematic embodiment of a rotor 350 according to the invention is shown. On the left side the upper, inner plane of a camshaft adjuster according to the invention is shown. The plane is broken toward the right side. In the plane which is located thereunder, the rotor 350 has a different form, so that further space is created for a driving element 300. The spring 200 is fastened with its ends 204 and 202 to the stator 100 or driving element 300. The driving element 300 has teeth of which two have been shown 302, 304. The one tooth engages in the rotor 350, the other tooth locks relative to the stator 100, preferably in a further circular position of the driving disc. The teeth 302, 304 may be located at different heights. The further parts of the camshaft adjuster 51 substantially correspond to the parts which are shown in FIGS. 4, 5, 6, 7 and 8.

FIG. 4 shows a camshaft adjuster 50 according to the invention. It is illustrated from the side of the chain wheel 52 which is provided all around with teeth, such as the tooth 54. The chain wheel has a marking 48 which represents the zero position. The chain wheel 52 is fastened by a cylindrical pin 70. The first bore 60, the second bore 62, the third bore 64, the fourth bore 66 and the fifth bore 68 are inserted into the webs 110, 112, 114, 116, 118 of the stator 100 which simultaneously represents a part of the housing. The bores 60, 62, 64, 66, 68 are provided as receivers for countersunk fixings. Such countersunk fixings are for example countersunk screws of the sizes M4, M5, M6 and M7.

Along the section A-A of FIG. 4 the camshaft adjuster 50 is illustrated in FIG. 5 from a further angle. In this view the position of the rotor 120 can be seen which forms the receiver 90. Furthermore, below the cover 80 for the spiral spring the spiral spring 200 can be seen, which is located in a specific space around the receiver 90. A cover plate 78 covers the rotor 120 and the stator 100 through which also bores are made for the countersunk fixings 64.

FIG. 6 shows the camshaft adjuster 50 along the section B-B of FIG. 5. A further view can be seen again along the section C-C of FIG. 5 in FIG. 7. In the section B-B of FIG. 6 the camshaft adjuster 50 exhibits the webs which are denoted by 110 for the first, 112 for the second, 114 for the third, 116 for the fourth and 118 for the fifth web. The rotor 120 is located in a position such that chambers of the first and second type are formed. In the Figures the chambers of the second type 170, 172, 174, 176, 178 are at a minimum. The chambers of the first type 160, 162, 164, 166, 168 are maximally extended relative thereto. The hydraulic medium may circulate through channels 150, 152, 154, 156, 158. The blades 122, 124, 126, 128, 130 move in the hydraulic medium and are reciprocated by the rotation of the rotor 120 between the respective associated webs 110, 112, 114, 116, 118.

FIG. 7 has channels 220, which is a first channel, 222 for the second channel, 224 for a third channel and 226 and 228 for a fourth and fifth channel. Moreover, the components are similar to FIG. 6.

The locking device can be seen very clearly in FIG. 8. It comprises the locking bolt 190 which in this case is a stepped bolt and is biased by a spring plate 192 together with a spring 194. The stepped bolt is guided in the locking guide 140. The spring 194 which is a locking spring, provides the biasing.

In FIG. 9 the spiral spring 200 of the camshaft adjuster 50 is shown from the side which is the opposite position to FIG. 4. The one end of the spiral spring 202 is supported relative to the cover plate 78 and is arrested by the notch 208. The other end 204 of the spiral spring 200 opens out in the collar 206 which engages around the bearing of the rotor 210. Moreover, in the Figure the tooth 302 is shown, which is represented in a stop position. Adjacent to the tooth the free-running region begins which allows the twisting of the rotor without the effect of a spring, and thus without torque. Only when the stop is in the other position does the additional counter torque have to be overcome by the spring.

The spiral spring 200 together with the locking device, or even in a further embodiment the locking bolt adjustable by pressure loading, implement the characteristic curve according to FIG. 1 in the camshaft adjuster, and which may also be denoted as a center lock with counter compensation for the torque. In the unlocked state, the free state, the spring creates a spring torque which increases when the camshaft to be received finds its way into its retarded position in the internal combustion engine. When the camshaft adjuster is solely provided with a hydraulic medium for the chambers and or the locking bolts, the locking is released at a pressure threshold X from which in the region II the spring torque acts or is in linear dependency between the crankshaft angle of rotation and the pressure loading.

The locking position is established for a camshaft adjuster by the choice of spring, the design of locking bolt and the size of engagement mechanism.

An adjuster according to the invention which is not reproduced precisely according to the Figures, on a static test bed exhibits behaviour which corresponds substantially to the characteristic curve according to FIG. 1. During the testing process individual adjustment angles are provided by pressure loading which may be altered. The adjustment angle is recorded. At the point X according to FIG. 1 which is dependent on the oil pressure, the locking pin is locked. In the region II of the characteristic curve the counter torque may be measured depending on the oil pressure.

An article according to the invention may thus be equipped with a specific driving disc but the driving functionality may also be present in suitable other components.

Due to the unmistakable advantages of an oscillating motor the invention is disclosed with different characteristic curves for the oscillating motor, or for the camshaft adjuster, according to operating conditions in such an embodiment, but it is understood that a person skilled in the art may develop a variant of the camshaft adjuster with an axial piston or helical gear teeth based on this invention.

| List of Reference Numerals | |
|---|---|
| 1 | linearized hydraulic cylinder according to the invention |
| 3 | Spring, in this case coil spring |

-continued

| List of Reference Numerals | |
|---|---|
| 5 | Bearing |
| 7 | Housing |
| 9 | Piston areas, washer - for sealing |
| 11 | Stop |
| 13 | Piston |
| 15 | Bleed line |
| 17 | Free-running region |
| 19 | Locking pin |
| 21 | Control line |
| 23 | Biasing spring |
| 48 | Marking |
| 50 | Camshaft adjuster in constructive view |
| 51 | Camshaft adjuster in schematic view |
| 52 | Chain wheel |
| 54 | Tooth of toothed wheel |
| 60, 62, 64, 66, 68 | Receivers for countersunk fixings (first, second, third, fourth, fifth bore) |
| 70 | Cylindrical pin |
| 78 | Cover plate |
| 80 | Cover |
| 90 | Receiver for camshaft |
| 100 | Stator |
| 110, 112, 114, 116, 118 | Webs |
| 120 | Rotor |
| 122, 124, 126, 128, 130 | Blades |
| 140 | Locking guide |
| 150, 152, 154, 156, 158 | Oil channel to the chambers |
| 160, 162, 164, 166, 168 | Chambers of the first type |
| 170, 172, 174, 176, 178 | Chambers of the second type |
| 190 | Stepped bolt |
| 192 | Spring plate |
| 194 | Spring |
| 200 | Return spring |
| 202, 204 | Ends of the spiral spring |
| 206 | Collar |
| 208 | Notch |
| 210 | Rotor bearing |
| 300 | Driving, element |
| 302, 304 | Teeth |
| 350 | Rotor, second type |
| L | Idling position |
| U | Gradient (produced by return spring, in particular spring torque of return spring) |
| X | Starting position |
| Y | Advanced position |
| Z | Retarded position |

We claim:

1. A camshaft adjuster comprising:

a rotor and a stator which together form a hydraulic oscillating motor, the stator comprising webs which face toward a center of the oscillating motor and together with the rotor form hydraulic chambers for a hydraulic medium, in which blades of the rotor move under pressure of the hydraulic medium, a torque spring, a locking pin having a biasing spring, and a mechanical stop which forms a stop position, wherein the stop is independent of the locking pin, and the stop is displaceable when a biasing force is exceeded.

2. The camshaft adjuster according to claim 1, wherein the torque spring, supported and fixedly anchored to a point of the stator, forms a counter torque against an introduced torque.

3. The camshaft adjuster according to claim 2, wherein the introduced torque comprises one of a torque which is produced by the pressure in the hydraulic chambers on the blades of the rotor or a torque which is introduced by means of a camshaft.

4. The camshaft adjuster according to claim 1, wherein the stop position is identical to a locking position, produced by locking the locking pin.

5. The camshaft adjuster according claim 1, wherein the torque spring is a horizontally constructed spiral spring which is arranged parallel to the rotor and encircles the center of the oscillating motor.

6. The camshaft adjuster according to claim 1, wherein the locking pin is provided in at least one of the blades which under a minimum pressure of the hydraulic medium anchors the rotor to the stator so that the rotor irrespective of the pressure carries out the same rotational movement as the stator.

7. The camshaft adjuster according to claim 1, wherein:

the camshaft adjuster has a cover which is fastened to the stator by, countersunk screws, and a chain wheel is located perpendicular to a side opposing the cover of the camshaft adjuster, at right angles to an axis located in the center of the camshaft adjuster.

8. The camshaft adjuster according to claim 1, wherein said stop comprises a block.

9. The camshaft adjuster according to claim 1, further comprising:

a first fixed stop; and a second fixed stop;

wherein said mechanical stop is displaceable in a region between the first and second stops.

10. A camshaft adjuster, comprising:

a rotor and a stator which together form a hydraulic oscillating motor, the stator comprising webs which face toward a center of the oscillating motor and together with the rotor form hydraulic chambers for a hydraulic medium, in which blades of the rotor move under pressure of the hydraulic medium, a torque spring, a locking pin, and a mechanical stop which forms a stop position. the stop being displaceable when a biasing force is exceeded, wherein a driving element is constructed between the stator and the rotor, said driving element being designed as a driving disc in the form of a closed ring, with teeth which may engage either in the rotor or in the stator and having a curved free-running region in at least one of the rotor and stator.

11. The camshaft adjuster according to claim 10, wherein:

a first end of the torque spring is connected to a point of the stator; and a second end of the torque spring opposite the first end acts on the driving element.

12. A camshaft comprising:

a rotor and a stator which together form a hydraulic oscillating motor, the stator comprising webs which face toward a center of the oscillating motor and together with the rotor form hydraulic chambers for a hydraulic medium, in which blades of the rotor move under pressure of the hydraulic medium, a torclue spring, a locking pin, and a mechanical stop which forms a stop position, the stop being displaceable when a biasing force is exceeded, wherein:

the torque spring is supported against a cover plate of the stator with a first end in a press fit, and a second end of the torque spring opens out in a collar which encircles an annulus of the rotor, the annulus being able to serve as a bearing of the rotor relative to the stator.

13. A camshaft adjuster of an internal combustion engine, comprising:

a stator and a rotor which may be moved relative to one another, at least two chambers formed by said rotor and said stator, said chambers being in counter rotation and adjustable in volume, a receiver for a camshaft, the rotor adapted to function as a camshaft adjuster which is adjustable by an oil pressure of the internal combustion engine for adjusting the camshaft with regard to its angle of rotation in relative rotation to a crankshaft, wherein:

at least two torque characteristic curves are provided; and the camshaft adjuster is adapted to select and follow one of said torque characteristic curves depending on an oil pressure loaded on said camshaft adjuster by, the internal combustion engine.

14. The camshaft adjuster according to claim 13, wherein:

said rotor and a stator together form a hydraulic oscillating motor, the stator comprising webs which face toward a center of the oscillating motor and together with the rotor form hydraulic chambers for a hydraulic medium, in which blades of the rotor move under pressure of the hydraulic medium, further comprising:

a torque spring, a locking pin, and a mechanical stop which forms a stop position, the stop is independent of said locking pin and is displaceable when a biasing force is exceeded.

15. The camshaft adjuster according to claim 14, wherein the torque spring, supported and fixedly anchored to a point of the stator, forms a counter torque against an introduced torque.

16. The camshaft adjuster according to claim 15, wherein the introduced torque comprises one of a torque which is produced by the pressure in the hydraulic chambers on the blades of the rotor or a torque which is introduced by means of a camshaft.

17. The camshaft adjuster according to claim 14, wherein the stop position is identical to a locking position, produced by locking the locking pin.

18. The camshaft adjuster according claim 14, wherein the torque spring is a horizontally constructed spiral spring which is arranged parallel to the rotor and encircles the center of the oscillating motor.

19. The camshaft adjuster according to claim 14, wherein the locking pin is provided in at least one of the blades which under a minimum pressure of the hydraulic medium anchors the rotor to the stator so that the rotor irrespective of the pressure carries out the same rotational movement as the stator.

20. The camshaft adjuster according to claim 14, wherein:

the camshaft adjuster has a cover which is fastened to the stator by, countersunk screws, and a chain wheel is located perpendicular to a side opposing the cover of the camshaft adjuster, at right angles to an axis located in the center of the camshaft adjuster.

21. The camshaft adjuster according to claim 14, wherein:

the torque spring is supported against a cover plate of the stator with a first end in a press fit, and a second end of the torque spring opens out in a collar which encircles an annulus of the rotor, the annulus being able to serve as a bearing of the rotor relative to the stator.

22. The camshaft adjuster according to claim 14, wherein said stop comprises a block.

23. The camshaft adjuster according to claim 14, further comprising:

a first fixed stop; and a second fixed stop;

wherein said mechanical stop is displaceable in a region between the first and second stops.

24. A camshaft adjuster comprising:

a stator and a rotor which may be moved relative to one another, at least two chambers formed by said rotor and said stator, said chambers being in counter rotation and adjustable in volume, a receiver for a camshaft of an internal combustion engine, the rotor adapted to function as a camshaft adjuster which is adjustable by an oil pressure of the internal combustion engine for adjusting the camshaft with regard to its angle of rotation in relative rotation to a crankshaft, wherein:

at least two torque characteristic curves are provided;

the camshaft adjuster is adapted to select and follow one of said torque characteristic curves depending on an oil pressure loaded on said camshaft adjuster by the internal combustion engine; and a driving element is constructed between the stator and the rotor, said driving element being designed as a driving disc in the form of a closed ring, with teeth which may engage either in the rotor or in the stator and have a curved free-running region in at least one of the rotor and stator.

25. The camshaft adjuster according to claim 24, wherein:

a first end of the torque spring is connected to a point of the stator; and a second end of the torque spring opposite the first end acts on the driving element.

* * * * *

UNITED STATES PATENT AND TRADEMARK OFFICE

CERTIFICATE OF CORRECTION

PATENT NO. : 7,278,385 B2
APPLICATION NO. : 11/369519
DATED : October 9, 2007
INVENTOR(S) : Knecht et al.

It is certified that error appears in the above-identified patent and that said Letters Patent is hereby corrected as shown below:

Column 11, line 61, claim 12, should read: -- a torque spring --

Column 12, line 12, claim 13, should read: -- a receiver for a camshaft of an internal combustion engine, --

Signed and Sealed this

Eighteenth Day of December, 2007

JON W. DUDAS
*Director of the United States Patent and Trademark Office*